US005618194A

United States Patent [19]

Maue et al.

[11] Patent Number: 5,618,194

[45] Date of Patent: Apr. 8, 1997

[54] ELECTRICAL PLUG DEVICE

[75] Inventors: Hans-Heinrich Maue, Bietigheim-Bissingen; Werner Hofmeister, Muehlacker; Dieter Egert, Korb; Dirk Langenhan, Schwieberdingen, all of Germany

[73] Assignee: Robert Bosch GmbH, Stuttgart, Germany

[21] Appl. No.: 560,261

[22] Filed: Nov. 21, 1995

[30] Foreign Application Priority Data

Mar. 27, 1995 [DE] Germany ..... 195 11 225.3

[51] Int. Cl.[6] ..... H01R 13/62

[52] U.S. Cl. ..... 439/157

[58] Field of Search ..... 439/157, 347, 439/310

[56] References Cited

U.S. PATENT DOCUMENTS 4,586,771 5/1986 Kraemer et al. ..... 439/157
5,205,753 4/1993 Butterfield et al. ..... 439/157
5,244,400 9/1993 Hatagishi ..... 439/157

FOREIGN PATENT DOCUMENTS 3645179 9/1986 Germany .

*Primary Examiner*—Neil Abrams
*Assistant Examiner*—Yong Kim
*Attorney, Agent, or Firm*—Kenyon & Kenyon

[57] ABSTRACT

An electrical plug device having two plug connector parts is designed in such a way that the two plug connector parts can be plugged together or separated by means of a slide, which can be displaced transversely with respect to the insertion direction, even under confined space conditions. To this end, guide openings are provided on one of the two plug connector parts, which guide openings extend through the plug connector part and serve the purpose of being able to assemble the U-shaped slide on both sides. Control elements or control means are fitted to the other of the two plug connector parts symmetrically with respect to its longitudinal extent, with the result that the engagement of assignable means or control elements which are fitted to the slide takes place with the same effect independently of the assembly direction of the slide. The plug device is preferably used in motor vehicles with confined installation conditions.

10 Claims, 3 Drawing Sheets

ELECTRICAL PLUG DEVICE

BACKGROUND INFORMATION

In the case of an electrical plug device, which consists of two plug connector parts which can be joined together, the force required to join together or separate the two plug connector parts is dependent on the number of plug contact elements which are in each case assigned in pairs in the plug device. If there is a large number of plug contact elements, the joining and separating force of the plug device can be applied only using an auxiliary means, which may be arranged directly on one of the two plug connector parts and is designed, for example, as a slide.

German Patent No. DE 36 45 179 C2 describes an electrical plug device, in which the auxiliary means used for joining and separating the plug device is a slide, which is arranged so that it can be displaced perpendicularly with respect to the insertion and separation direction, is of U-shaped design, has parallel legs extending from a web, and can be inserted by the legs through guide openings on one of the transverse sides of the one plug connector part.

Starting from an unlocking position, which forms one of the two end positions of the slide, in which the legs are passed through the guide openings only over part of their length and in which the two plug connector parts can be brought together for the purpose of making contact, the slide can be displaced into the other end position, the locking position, when the web is laid against the transverse wall, in which the guide openings are located, of the one plug connector part. As a result of the legs being completely pushed into the one plug connector part in the process, the plug device is closed when the plug contact elements make contact.

When the plug device is used under confined space conditions, for example directly on units in the engine compartment of a motor vehicle, it can be disadvantageous that the capability of assembling the slide with respect to the unlocking position, in which the plug device has a large space requirement due to the necessary spacing of the web from the transverse wall of the one plug connector part, can take place only in one direction. This is particularly disadvantageous when the plug device is manufactured in large numbers for the purpose of cost-effective production and iS intended to be used under a wide variety of installation conditions.

SUMMARY OF THE INVENTION

The plug device according to the present invention has the advantage that the above-mentioned shortcoming is avoided. For this purpose the plug device is designed in such a way that the one plug connector part has identical guide openings, which are aligned with one another, on two opposite sides, with the result that the slide can be inserted optionally from each of these sides and can be displaced for the purpose of locking or unlocking the plug connection. At the same time, the control elements or control means are fitted to the other of the two plug connector parts, symmetrically with respect to its longitudinal extent, with the result that the engagement of assignable control means or control elements of the slide takes place with the same effect independently of the assembly direction of the slide.

As a result, the plug device is easy to manipulate even under different confined installation conditions and, by virtue of the manifold possible uses, can be produced in a standardized manner in large numbers and, thus, cost-effectively.

The design of the plug device with three pairs of opposite, symmetrical attachments leads in particular to a minimized actuation force if the slide takes up the load symmetrically, which minimized actuation force cannot be achieved with other arrangements, for example with two pairs of opposite attachments.

DETAILED DESCRIPTION

Figure 1:
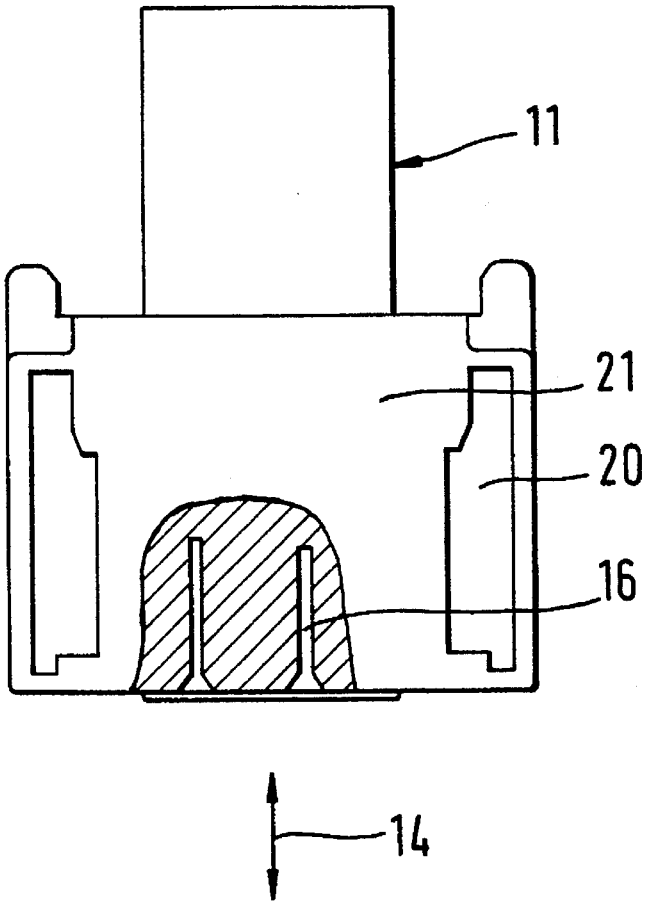
FIG. 1 diagrammatically shows a side view of a first plug connector part of a plug device, according to the present invention.
Figure 2:
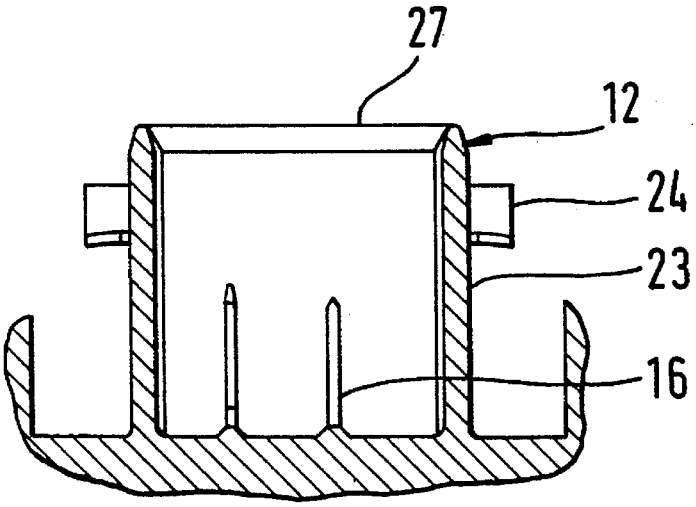
FIG. 2 shows a cross section of a second plug connector part of the plug device, according to the present invention.
Figure 3:
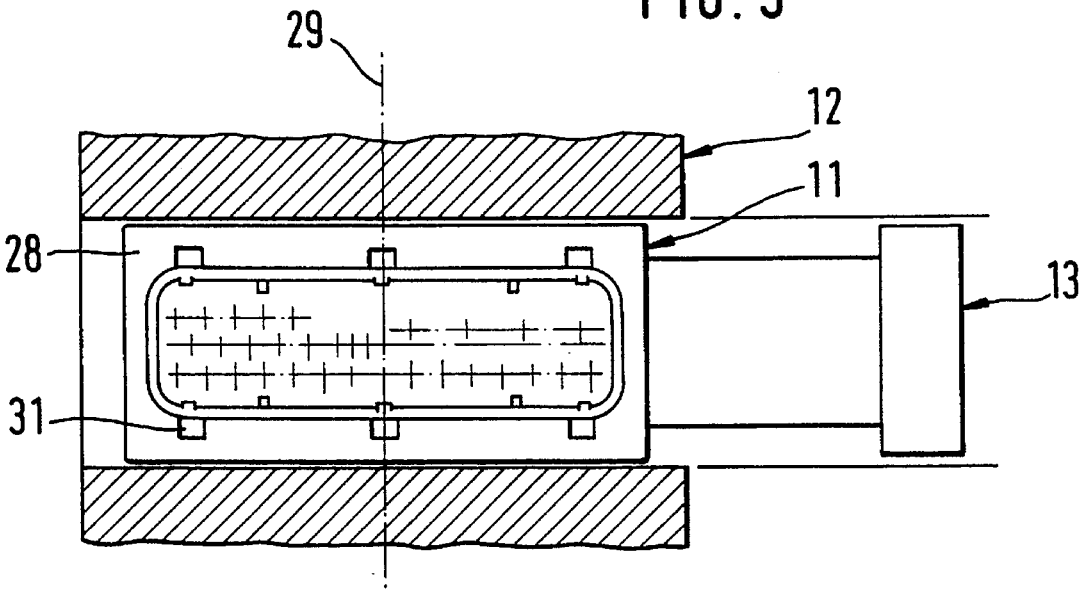
FIG. 3 shows a bottom view of the two plug connector parts and of a slide, according to the present invention.

The electrical plug connection is essentially composed of a first plug connector part 11 according to FIG. 1, a second plug connector part according to FIG. 2, and a slide 13 according to FIG. 3. The slide 13 is mounted on the first plug connector part 11 and can be displaced perpendicularly with respect to the insertion and separation direction, running along an arrow 14 (FIG. 1), of plug contact elements 16 of the two plug connector parts 11, 12.

When the plug connector parts 11, 12 are brought together for the purpose of making contact, they are displaced relative to one another, as a result of the movement of the slide 13 from one end position, the unlocking position, into the other end position, the locking position, until assigned plug contact elements 16 of the two plug connector parts 11, 12 make contact.

Figure 4:
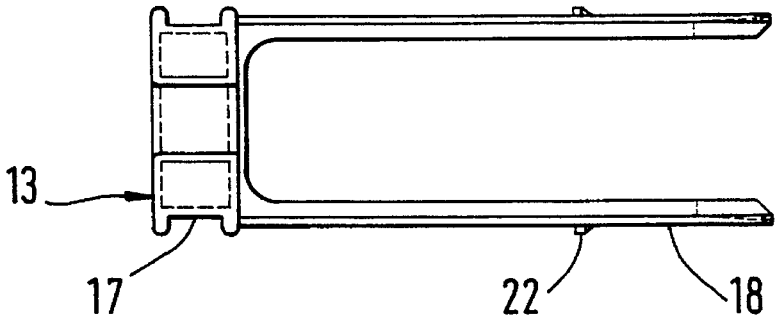
FIG. 4 shows a plan view of the slide.

As is evident from FIG. 4, the slide 13 has a U-shaped design; it has a web 17 as a base and handling part, as well as parallel, flat legs 18 which_have a rectangular basic shape and extend away from the web 17.

Figure 5:
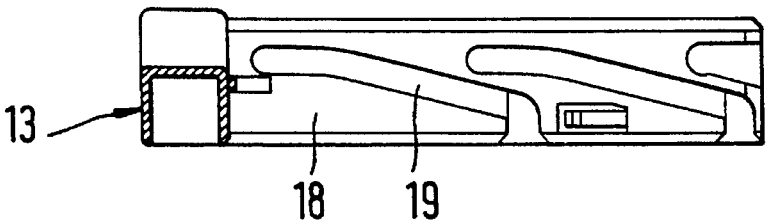
FIG. 5 shows a side view of the slide.

In accordance with FIG. 5, three (integrally molded) control means in the form of control grooves 19 are formed identically in each of the two legs 18. The slide 13 can be pushed in by its legs 18 through guide openings 20 which are in the form of slots and, starting from parallel, opposite transverse walls 21 of the first plug connector part 11 are aligned with one another in pairs and extend through the first plug connector part. The slide 13 can be releasably latched in the two end positions by means of latching lugs 22 which project from the legs 18 and can be latched into assigned latching openings (not illustrated in greater detail) of the first plug connector part 11.

Three pin-shaped control elements, which have a partially conical shape and are in the form of attachments 24, are fitted, projecting outward, to each of the parallel, opposite longitudinal walls 23 of the second plug connector part 12 (FIGS. 2, 6, 7, 8). The respective center attachment 24 lies on a center axis 26 (illustrated in FIG. 6) of the second lug connector part 12, whereas the other attachments 24, which are each at the same distance from the center axis 26, are fitted in the end regions of the second plug connector part 12. All of the attachments 24 are situated near an end wall 27, adjoining the longitudinal walls 23, of the second plug connector part 12, and they each have the same distance from the end wall.

Figure 6:
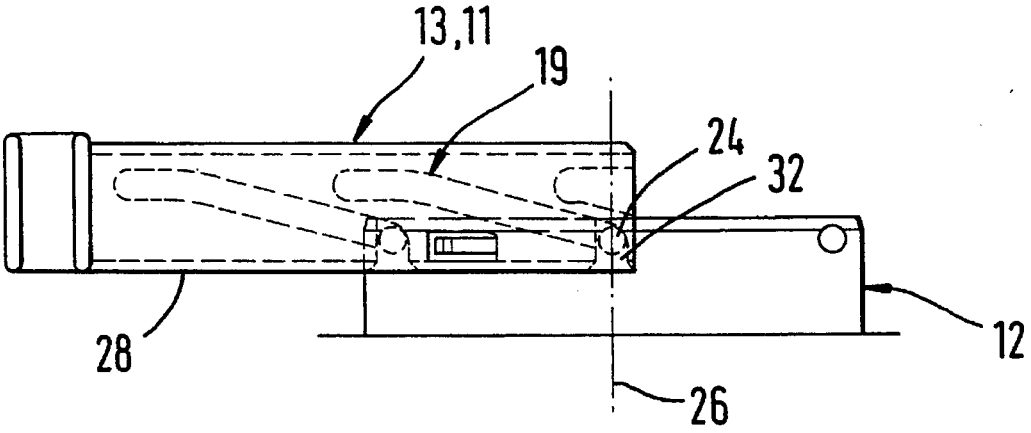
FIG. 6 diagrammatically shows a side view of the slide and the second plug connector part, in a first position during the transition from an unlocking position to a locking position.

FIG. 3, which shows, inter alia, a bottom view of the first plug connector part 11, illustrates an end wall 28, a center axis 29 and recesses 31 in the first plug connector part 11. The recesses 31, which are each larger than an attachment 24 by a joining clearance, are arranged in such a way that when the two plug connector parts 11, 12 are brought together with mutually facing end walls 27, 28 and congruent center axes 26, 29, each of the attachments 24 enters an assigned recess 31 and comes into the engagement region of the slide 13. If the slide 13, as illustrated in FIG. 6, is in the unlocking position, then in each case two attachments 24 pass into assigned insertion regions 32 of control grooves 19, which insertion regions run in the insertion and separation direction and are open in the shape of a funnel toward the end wall 28.

Figure 7:
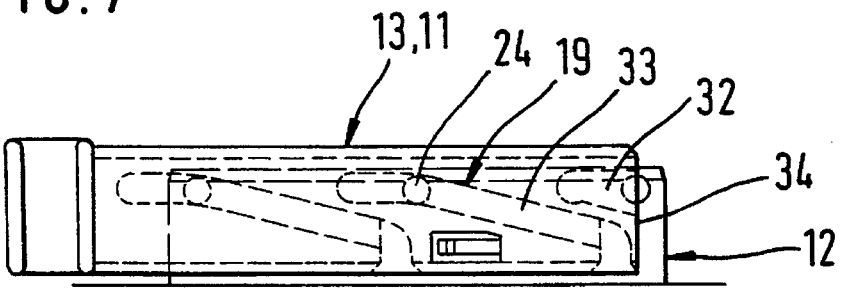
FIG. 7 diagrammatically shows a side view of the slide and the second plug connector part, in a second position during the transition from an unlocking position to a locking position.

When the slide 13 moves toward the locking position, as illustrated in FIG. 7, the attachments 24, which are initially situated in the insertion regions 32 of the control grooves 19, each slide along a movement section 33 of the control grooves 19 which runs with an inclination at an angle of approximately 80° C. to the insertion and drawing direction. At the end of the movement of the slide 13, the remaining two attachments 24 pass into the assigned insertion regions 32, which are open toward a transverse wall 34.

This movement of the slide 13 and the guidance of the attachments 24 in the control grooves 19 produce a lifting movement of the second plug connector part in the insertion direction. In the process, contact is made between the assigned plug contact elements 16 of the two plug connector parts 11, 12.

Figure 8:
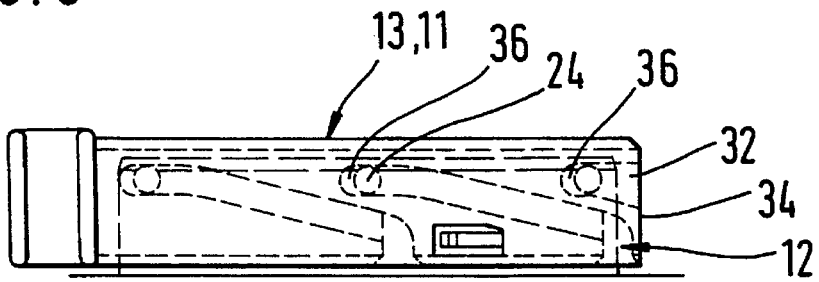
FIG. 8 diagrammatically shows a side view of the slide and the second plug connector part, in a third position during the transition from an unlocking position to a locking position.

In the event of continued movement of the slide 13 toward the locking position, as illustrated in FIG. 8, all of the attachments 24 slide into retaining sections 36 of the control grooves 19, which retaining sections run approximately perpendicularly with respect to the insertion and separation direction, the insertion regions 32 merging directly with the retaining sections 36 in the case of the control grooves 19 which start at the transverse wall 34.

In comparison with the retaining sections 36 of the outer control grooves 19, the retaining sections of the center control grooves 19 are arranged in such a way that, in the locking position, the center pair of attachments 24 is released from the assigned retaining sections 36 and the slide 13 is supported, for the purpose of taking up the load symmetrically, only on the outer retaining sections 36.

When the slide 13 reaches the locking position, the two plug connector parts 11, 12 are connected to one another in a functionally correct manner.

When the slide 13 is moved for the purpose of separating the two plug connector parts 11, 12, a movement sequence is produced, by analogy, in the reverse direction.

The symmetrical arrangement of the attachments 24 on the second plug connector part 12, the recesses 31 matched thereto in the end wall 28 of the first plug connector part 11, and the guide slots 20 extending through the first plug connector part 11 provide the preconditions for the capability of assembling the slide 13 on both sides, in conjunction with locally uniform pressure on the plug connector parts 11, 12 in the locking position of the slide, which takes place with the same effect independently of the assembly direction of the slide.

What is claimed is:

1. An electrical plug device comprising:

a first plug connector part having at least one first plug contact element and first and second guide openings, the first guide opening extending through a first side of the first plug connector part, the second guide opening extending through a second side of the first plug connector part;

a second plug connector part having at least one second plug contact element and first and second control elements, the first and second control elements being disposed symmetrically with respect to a longitudinal axis of the second plug connector part; and a slide for bringing together and separating the first and second plug contact elements and, thus, the first and second plug connector parts by moving transversely with respect to a separation direction of the first and second plug contact elements, the slide being adapted to be inserted into the first plug connector part, the slide having a U-shaped configuration, the slide including a web and two parallel legs, each of the two legs having a first end coupled to the web and a control portion for cooperating with at least one of the first and second control elements of the second plug connector part.

2. The plug device according to claim 1, wherein the first side of the first plug connector part is opposite the second side of the first plug connector part.

3. The plug device according to claim 1, wherein:

each of the control portions has a plurality of control grooves; and each of the control elements includes an attachment.

4. The plug device according to claim 1, wherein:

each of the control portions includes at least one attachment; and each of the control elements has a control groove.

5. The plug device according to claim 3, wherein:

the attachments are pin-shaped; and the control grooves are inclined with respect to the separation direction.

6. The plug device according to claim 3, wherein the first and second plug connector parts are approximately parallelepipedal.

7. The plug device according to claim 6, wherein:

the second plug connector part has at least first and second longitudinal walls; and each of the longitudinal walls is fitted with three attachments, a position of each of the attachments on the first longitudinal wall being opposite to a position of a corresponding attachment on the second longitudinal wall.

8. The plug device according to claim 7, wherein:

each of the control portions has three control grooves;

two of the attachments engage two of the control grooves when the first and second plug connector parts are brought together for making contact; and a third of the attachments does not engage a third of the control grooves until the slide moves from an unlocking position toward a locking position.

9. The plug device according to claim 8, wherein each of the control grooves has a retaining section, the attachments passing into the retaining sections in the locking position.

10. The plug device according to claim 9, wherein:

the retaining sections include a center retaining section and two outer retaining sections; and in the locking position, a center attachment corresponding to the center retaining section is released from the center retaining section, and the slide is supported only on the outer retaining sections.

* * * * *